US008261460B2

(12) United States Patent
Essel

(10) Patent No.: US 8,261,460 B2
(45) Date of Patent: Sep. 11, 2012

(54) LINE HOLDERS FOR MASONRY WORK AND THE LIKE

(75) Inventor: Randall L. Essel, Wickliffe, OH (US)

(73) Assignee: Linovation Corp., Wickliffe, OH (US)

( * ) Notice: Subject to any disclaimer, the term of this patent is extended or adjusted under 35 U.S.C. 154(b) by 203 days.

(21) Appl. No.: 12/798,698

(22) Filed: Apr. 9, 2010

(65) Prior Publication Data

US 2011/0247226 A1 Oct. 13, 2011

(51) Int. Cl.
*B43L 7/00* (2006.01)
*G01B 1/00* (2006.01)

(52) U.S. Cl. ..... 33/404; 33/413

(58) Field of Classification Search ..... 33/404, 33/407–410, 413, 414, 415, 1 LE
See application file for complete search history.

(56) References Cited

U.S. PATENT DOCUMENTS

| | | | | |
|---|---|---|---|---|
| 391,496 | A | 10/1888 | Vogelsong | 33/408 |
| 461,021 | A | 10/1891 | Koehler | 33/408 |
| 492,636 | A | 2/1893 | Snyder | 33/409 |
| 598,342 | A | 2/1898 | Hawkins | 24/570 |
| 656,431 | A | 8/1900 | Stewart | 24/130 |
| 765,250 | A | 7/1904 | McPherson | 33/409 |
| 817,357 | A | 4/1906 | Zugelder | 33/409 |
| 847,824 | A | 3/1907 | Roberts | 33/409 |
| 927,790 | A | 7/1909 | Hall | 33/407 |
| 955,714 | A | 6/1911 | Platt | 451/90 |
| 1,044,805 | A | 11/1912 | Normand | 24/571 |
| 1,066,926 | A | 7/1913 | Lee | 33/409 |
| 1,075,166 | A | 10/1913 | Smyth | 33/409 |
| 1,080,836 | A | 12/1913 | Lake | 271/182 |
| 1,092,058 | A | 3/1914 | Knott et al. | 33/410 |
| 1,135,736 | A | 4/1915 | Steuler | 24/129 |
| 1,193,665 | A | 8/1916 | Coburn | 33/409 |
| 1,293,572 | A | 2/1919 | Sullivan | 24/571 |
| 1,466,563 | A | 8/1923 | Rutherford | 24/115 |
| 1,480,006 | A | 1/1924 | Ortman | 24/129 |
| 1,488,382 | A | 3/1924 | Crow | 24/555 |
| 1,502,274 | A | 7/1924 | Scott | 29/412 |
| 1,594,836 | A | 8/1926 | Igram | 33/408 |
| 1,643,880 | A | 9/1927 | Elder | 33/339 |
| 2,204,117 | A | 6/1940 | Brammer | 474/241 |
| 2,208,085 | A | 7/1940 | Sabiston | 33/408 |
| 2,215,663 | A | 9/1940 | Frisk | 33/408 |
| 2,229,935 | A | 1/1941 | Powers | 24/131 |

(Continued)

*Primary Examiner* — Yaritza Guadalupe-McCall
(74) *Attorney, Agent, or Firm* — David A. Burge

(57) ABSTRACT

A relatively thin, stiff, flat guide line holder or "trig" for accurately supporting and positioning intermediate portions of tautly stretched guide lines such as are used by bricklayers and stone masons in laying courses of bricks, blocks and stones during the erection of masonry walls has a centrally located body portion, and an integrally formed, forwardly projecting guide line support portion. During use, the body portion is positioned atop a flat surface of a wall being erected to support the line holder at a desired height to be met by masonry elements added to the wall, with the support portion projecting forwardly beyond a front surface plane of the wall being erected. Passage formations defined by the support portion open downwardly through a bottom surface of the support portion at two spaced locations along the front surface plane when the line holder is properly positioned. Slot formations defined by the support portion provide a track, or tracks, along which a loop of the guide line can be moved into the passage formations so lengthy portions of the guide line located on opposite sides of the loop can extend along the front surface plane in opposite directions away from the line holder when the guide line is drawn taut at the desired height.

20 Claims, 9 Drawing Sheets

U.S. PATENT DOCUMENTS

| | | | | | |
|---|---|---|---|---|---|
| 2,356,908 | A | | 8/1944 | Arrowsmith | 248/353 |
| 2,407,389 | A | | 9/1946 | Stevens | 33/409 |
| 2,446,253 | A | | 8/1948 | Tresidder | 33/409 |
| 2,452,175 | A | | 10/1948 | Atkins | 24/137 |
| 2,492,044 | A | | 12/1949 | Hulquist | 33/410 |
| 2,505,606 | A | | 4/1950 | Coffey | 33/409 |
| 2,505,935 | A | | 5/1950 | Batchler | 33/409 |
| 2,508,076 | A | | 5/1950 | Palmer | 33/410 |
| 2,523,101 | A | | 9/1950 | Edixon | 33/408 |
| 2,529,056 | A | | 11/1950 | Sprowl | 33/408 |
| 2,530,121 | A | | 11/1950 | Garwood | 33/408 |
| 2,533,341 | A | * | 12/1950 | Alfano | 33/414 |
| 2,544,645 | A | | 3/1951 | Alwood | 33/407 |
| 2,559,697 | A | | 7/1951 | Anders | 33/409 |
| 2,585,160 | A | | 2/1952 | Munn | 33/409 |
| 2,592,717 | A | | 4/1952 | Mann | 33/409 |
| 2,600,091 | A | | 6/1952 | Becker | 24/137 |
| 2,603,875 | A | | 7/1952 | Kroll | 33/409 |
| 2,611,963 | A | | 9/1952 | Zinken | 33/408 |
| 2,618,858 | A | | 11/1952 | Zinken | 33/410 |
| 2,623,290 | A | | 12/1952 | Kampel | 33/410 |
| 2,629,177 | A | | 2/1953 | Zinken | 33/410 |
| 2,629,178 | A | | 2/1953 | Zinken | 33/410 |
| 2,659,973 | A | | 2/1953 | Patzel | 33/410 |
| 2,663,938 | A | | 12/1953 | Stodgell | 33/413 |
| 2,665,487 | A | | 1/1954 | Mastrella | 33/408 |
| 2,667,695 | A | | 2/1954 | Price | 33/409 |
| 2,723,457 | A | | 11/1955 | Wasilewski | 33/409 |
| 2,735,183 | A | | 2/1956 | Taylor | 33/409 |
| 2,785,467 | A | | 3/1957 | Andersen | 33/408 |
| 2,800,719 | A | | 7/1957 | Tuzicka | 33/409 |
| 2,802,270 | A | | 8/1957 | Christoffersen | 33/409 |
| 2,806,290 | A | | 9/1957 | Tiefel | 33/408 |
| 2,834,112 | A | * | 5/1958 | Seagraves | 33/409 |
| 2,865,107 | A | | 12/1958 | Castano | 33/409 |
| 2,893,125 | A | | 7/1959 | Kampel | 33/407 |
| 2,948,065 | A | | 8/1960 | Simonic | 33/409 |
| 3,039,195 | A | | 6/1962 | Litty | 33/404 |
| 3,119,186 | A | | 1/1964 | Stewart | 33/408 |
| D198,813 | S | | 8/1964 | Stone | D8/71 |
| 3,148,453 | A | | 9/1964 | DiCarlo | 33/410 |
| 3,156,982 | A | | 11/1964 | Wahlin | 33/408 |
| 3,183,595 | A | | 5/1965 | Jopperi | 33/408 |
| 3,205,582 | A | | 9/1965 | Andrews | 33/407 |
| 3,276,129 | A | | 10/1966 | Andrews | 33/407 |
| 3,299,515 | A | | 1/1967 | Lessard | 33/408 |
| 3,327,395 | A | | 6/1967 | Zenke | 33/407 |
| 3,402,437 | A | | 9/1968 | Meletti | 24/137 |
| 3,408,742 | A | | 11/1968 | Caprio et al. | 33/409 |
| 3,440,728 | A | | 4/1969 | Hackworth, Sr. | 33/410 |
| 3,461,565 | A | | 8/1969 | Harris | 33/408 |
| 3,555,688 | A | | 1/1971 | Smathers | 33/408 |
| D221,511 | S | | 8/1971 | Dufault | D8/5 |
| 3,626,434 | A | | 12/1971 | Miller | 33/408 |
| 3,698,089 | A | | 10/1972 | Huston | 33/408 |
| 3,729,828 | A | | 5/1973 | McKenzie | 33/408 |
| 3,765,096 | A | | 10/1973 | Simmons et al. | 33/409 |
| 3,781,761 | A | | 12/1973 | Harwood | 339/75 P |
| 3,961,387 | A | | 6/1976 | Porter | 7/5.6 |
| 4,031,627 | A | | 6/1977 | Dar | 33/409 |
| D251,059 | S | | 2/1979 | Montell | D10/64 |
| 4,143,462 | A | | 3/1979 | Gertz | 33/414 |
| 4,599,804 | A | | 7/1986 | Amos | 33/408 |
| 4,932,135 | A | | 6/1990 | Wobser, II | 33/408 |
| 4,937,946 | A | | 7/1990 | Steinhoff | 33/410 |
| D314,920 | S | * | 2/1991 | Blazek | D10/61 |
| 4,995,152 | A | | 2/1991 | Steckler | 24/129 |
| 5,009,015 | A | * | 4/1991 | Redl | 33/409 |
| 5,125,162 | A | | 6/1992 | Prebeck | 33/408 |
| D347,798 | S | | 6/1994 | Tindoll | D10/65 |
| 5,479,713 | A | | 1/1996 | Wood | 33/407 |
| D369,756 | S | | 5/1996 | Noel | D10/64 |
| 6,412,184 | B1 | | 7/2002 | Heavner | 33/409 |
| 6,415,519 | B1 | * | 7/2002 | Bennett | 33/414 |
| D488,372 | S | | 4/2004 | Gambrell | D8/356 |
| 6,842,992 | B1 | * | 1/2005 | Gitt | 33/404 |
| 7,098,406 | B1 | | 8/2006 | Hammonds | 174/154 |
| D576,060 | S | | 9/2008 | Rider | D10/65 |
| D576,867 | S | | 9/2008 | Kretz | D8/356 |
| D577,619 | S | | 9/2008 | Rider | D10/65 |
| 7,506,454 | B1 | * | 3/2009 | Balliet | 33/414 |
| 7,513,053 | B1 | | 4/2009 | Sidebottom, Jr. | 33/408 |
| 7,770,299 | B2 | | 8/2010 | Clancy | 33/408 |
| D639,683 | S | * | 6/2011 | Essel | D10/65 |
| D639,684 | S | * | 6/2011 | Essel | D10/65 |
| 2007/0089312 | A1 | | 4/2007 | Wade | 33/409 |
| 2008/0000096 | A1 | * | 1/2008 | Wade | 33/404 |
| 2008/0301958 | A1 | | 12/2008 | Darty | 33/409 |
| 2009/0320306 | A1 | | 12/2009 | Clancy | 33/408 |
| 2011/0247226 | A1 | * | 10/2011 | Essel | 33/404 |

* cited by examiner

LINE HOLDERS FOR MASONRY WORK AND THE LIKE

REFERENCE TO CONCURRENTLY-FILED DESIGN APPLICATION

Reference is made to a design patent application entitled MASON'S GUIDE LINE HOLDERS OR SIMILAR ARTICLES filed concurrently herewith by the inventor hereof, issued Jun. 14, 2011 as U.S. Design Pat. No. D639, 683, the disclosure of which is incorporated herein by reference.

BACKGROUND

The present invention relates to line holders of a type used by bricklayers and stone masons to support intermediate portions of tautly stretched guide lines along which courses of bricks, blocks and stones are to be laid in proper alignment as walls are built. The line holder, also known as a "trig," positions an intermediate reach of a guide line, also known as a "trig line," to correspond with a top surface height at which, and the location of a front surface plane along which, bricks, blocks and stones are to be accurately laid as masonry walls are erected.

Over the years, a variety of line holders or trigs have been proposed, some being more complexly configured than others, and some being more difficult to employ than others. An unduly complex and clumsy to employ trig line holder intended to support an intermediate reach of a trig line is disclosed in U.S. Pat. No. 3,148,453—which has gained little acceptance due to its complexity and relatively high cost of manufacture, and its lack of ease of use.

A much simpler trig line holder formed from a folded metal strip that has gained a reasonable degree of acceptance is disclosed in U.S. Pat. No. 3,961,387—but provides a design employing overlying components that are difficult to separate when a trig line must be inserted between the overlying components to put the holder into use. Drawbacks commonly encountered with this form of line holder are the ease with which it quickly becomes bent beyond being reused, and the loosening of its grip on guide lines—both of which problems are commonly encountered after relatively few uses of this line holder.

A simpler, repeatedly reusable, easier-to-employ line holder or "trig" has long been needed. The line holder or trig of the present invention cleverly addresses, and is quite well suited to fill, this long-standing need.

SUMMARY

The present invention provides line holders or trigs of simple, compact and lightweight construction, that are inexpensive to manufacture, that are repeatedly reusable without likelihood of becoming bent or otherwise being damaged during normal use, and that are conveniently carried in a bricklayer's or stone mason's pocket so as to be ready for use when needed. If one should be lost, the low cost of a replacement is negligible.

Of primary importance is the accuracy with which line holders or trigs embodying the invention are capable of reliably supporting and positioning a guide line, without introducing even an error that corresponds to a thickness of the material from which the line holder or trig is formed.

Some embodiments preferably take the form of a relatively thin, stiff and substantially flat member that has a centrally located body portion and a forwardly projecting guide line support portion. The body portion is positionable atop a flat surface to support the line holder at a proper height to be met as masonry elements are added to a wall. When the line holder is properly positioned, the forward line support portion defines a pair of passages that open downwardly in a front surface plane of the wall along which added masonry elements are to extend. Slot formations defined by the support portion permit a loop of guide line to be introduced into the passages so the guide line can be supported by the line holder when the guide line is stretched tautly in opposite directions along the front surface plane of the wall and at the proper height.

In some embodiments, a line holder includes a thin, elongate, generally rectangular member having two side-by-side passages that extend through the member at locations spaced short distances from one end surface of the member, having a single passage extending through the member at a location spaced a short distance from an opposite end surface of the member, having a pair of side-by-side slots each communicating with a different one of the side-by-side passages and extending through the one end surface, and having a single slot communicating with the single passage and extending through the opposite end surface.

In some embodiments, a line holder includes a thin, flat, relatively stiff member having a centrally located body portion postponable atop a horizontal surface at a desired height, and a forwardly projecting guide line support portion adapted to extend forwardly from the front surface plane 1) to define passage means configured to open downwardly through a bottom surface of the support portion at two side-by-side locations along a path extending at the desired height adjacent the front surface plane, and 2) to define slot means communicating with the passage means and configured to permit insertion of the loop into the downwardly opening passage means so the loop is supported by the line holder when the guide line is drawn taut in opposite directions extending along the path.

In some embodiments, a line holder includes a stiff, flat strip having an end region that defines two side-by-side passages extending through the strip at locations spaced a relatively short distance from an end surface of the end region, and that defines two side-by-side elongate slots each having a slot portion located adjacent to and communicating with a different one of the passages, with the slots extending in a length direction to open through the end surface, and with the passages having widths measured transverse to the length direction that are greater than are widths of slot portions located adjacent to and communicating with the passages.

In some embodiments, a line holder includes a stiff, flat, elongate strip having two side-by-side passages extending through the strip at locations spaced substantially equidistantly from an end surface of the strip, wherein the passages each communicate with a different one of two slots extending through a thickness of the strip and in a length direction to open through the end surface, wherein the openings are transversely wider than are portions of the slots located adjacent to and communicating with the openings.

In some embodiments, a line holder for supporting and positioning an intermediate reach of a mason's guide line when drawn taut to extend away from the line holder in opposite directions along a linear path at a desired height within a front surface plane of a wall being built, includes a thin, stiff, elongate member having a centrally located body portion postponable atop a horizontal surface at the desired height, and having a guide line support portion formed integrally with and projecting forwardly from the body portion 1) to define passage means opening downwardly through a bottom surface of the support portion at two locations along the linear path within the front surface plane, and 2) to define slot means communicating with the passage means and opening through an edge surface of the elongate member to provide a track that can be followed when inserting a loop of the reach into the passage means to depend through the bottom surface at said locations.

In some embodiments, a line holder is formed as a stamping from a thin, stiff, flat, elongate strip of metal having one and opposite end regions that define one and opposite end surfaces, respectively, having two side-by-side passages extending through a thickness of the one end region, having a single passage extending through a thickness of the opposite end region, with separate slots extending through the thickness of the one end region from each of the side-by-side openings and through the one end surface, and with another slot extending through the thickness of the opposite end region from the single passage and through the opposite end surface.

BRIEF DESCRIPTION OF THE DRAWINGS

These and other features, and a fuller understanding of the invention may be had by referring to the following description and claims, taken in conjunction with the accompanying drawings, wherein:

DETAILED DESCRIPTION

Figure 1:
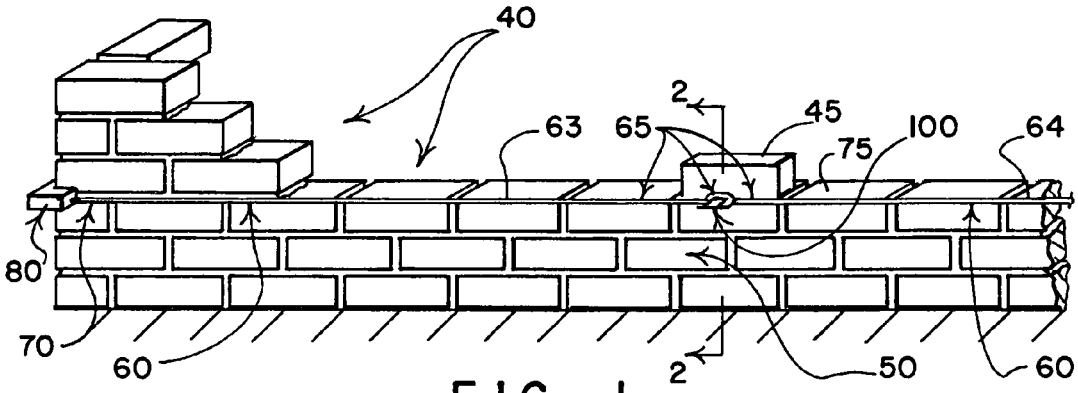
FIG. 1 is a perspective view of a portion of a brick wall being erected, with a guide line shown extending along a linear path adjacent a front surface plane of the wall at a desired height to be met by bricks being added to the wall, with an intermediate portion of the guide line being supported and held properly in position by a line holder or "trig" embodying features of the invention that, in turn, is held in place by an overlying brick.

Referring to FIG. 1, a brick wall being built or erected is indicated generally by the numeral 40. A front surface plane of the wall 40 is indicated by the numeral 50. A guide line drawn taut to extend along a linear path 61 closely adjacent the front surface plane 50 of the wall 40 at a desired height to be met by bricks being added to the wall 40 is indicated by the numeral 60.

A left end region 70 of the guide line 60 may be supported by any of a variety of conventional guide line holders 80, examples of which are disclosed in U.S. Pat. Nos. D-347,798, D-198,813, 6,412,184, 5,479,713 and 2,585,160, the disclosures of which are incorporated herein by reference, or by other conventional techniques well known to those skilled in the art. Likewise, a right end region of the guide line 60 (not shown) may also be supported by a conventional guide line holder such as is disclosed in the patents just mentioned, or by other conventional techniques well known to those skilled in the art. An intermediate portion 65 of the guide line 60 is supported by a line holder 100 that preferably embodies features of the present invention.

Figure 3:
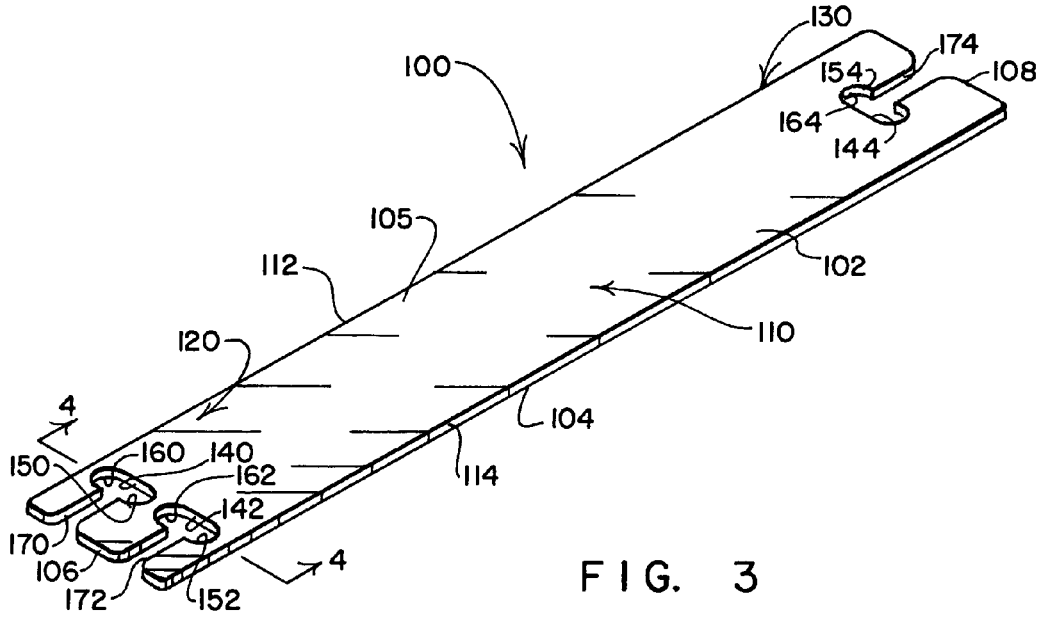
FIG. 3 is a perspective view on an enlarged scale of a relatively thin, stiff and substantially flat line holder or "trig" depicting one form that can be taken by the invention.

Referring to FIG. 3, the line holder 100 is a one-piece, flat, thin, elongate, generally rectangular strip 105 that can be thought of as having three portions, namely a centrally located, relatively lengthy body portion 110, a relatively stubby front end region referred to as a dual-passage guide line support portion 120, and a similar, relatively stubby rear end region referred to as a single-passage guide line support portion 130. As is clearly depicted in FIG. 3, and as will shortly be explained in detail regarding this embodiment, the front end region 120 has only two passages 140, 142 formed therethrough accompanied by a pair of corresponding slots 170, 172 communicating therewith, and the rear end region has only a single passage 144 formed therethrough accompanied by a single slot 174 communicating therewith.

Novelty resides in the combination of the central body portion 110 and the uniquely configured front support portion, for previously proposed line holders have not provided such features; and, novelty resides in providing the central body portion 110 together with the odd combination of front and rear end regions 120, 130, respectively, that are capable in functioning in different ways to serve different guide line support needs found in different masonry wall erection applications, as will be explained later herein.

The embodiment of the line holder 100 shown in FIG. 3 has a top surface 102, a bottom surface 104, a forward end surface 106, a rearward end surface 108, and substantially parallel extending left and right edge surfaces 112, 114. Two side-by-side passages 140, 142 are formed through the front end region 120 of the line holder 100 at locations spaced identical short distances from the forward end surface 106. A single passage 144 is formed through the rear end region 130 of the line holder 100 at a location spaced a similar short distance from the rearward end surface 108. Each of the passages 140, 142, 144 extends substantially vertically through the line holder 100 so as to open at one end through the top surface 102, and at the other end through the bottom surface 104.

Figure 4:
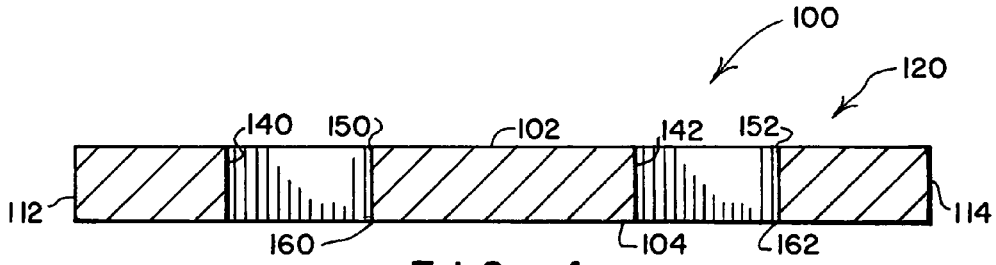
FIG. 4 is a cross-sectional view on a still more enlarged scale, as seen from a plane indicated by a line 4-4 in FIG. 3.
Figure 5:
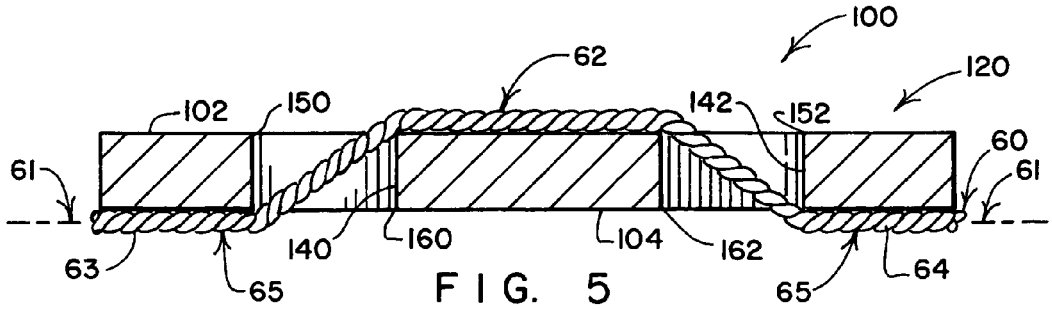
FIG. 5 is a cross-sectional view similar to FIG. 4 and showing how a guide line loop preferably extends through passages and across the top of a central portion of the line holder of FIGS. 3 and 4.

Turning to FIG. 4, where the passages 140, 142 open through the top surface 102, the side-by-side passages 140, 142 define side-by-side openings 150, 152, respectively. Where the passages 140, 142 open the bottom surface 104, the side-by-side passages 140, 142 define side-by-side openings 160, 162, respectively. Where the solo passage 144 opens through the top and bottom surfaces 102, 104, the passage 144 defines top and bottom surface openings 154, 164, respectively.

Referring again to FIG. 3, a pair of side-by-side slots 170, 172 communicate with the side-by-side passages 140, 142, respectively, and open through the forward end surface 106. Similarly, a slot 174 communicates with the passage 144, and opens through the rearward end surface 108.

Figure 2:
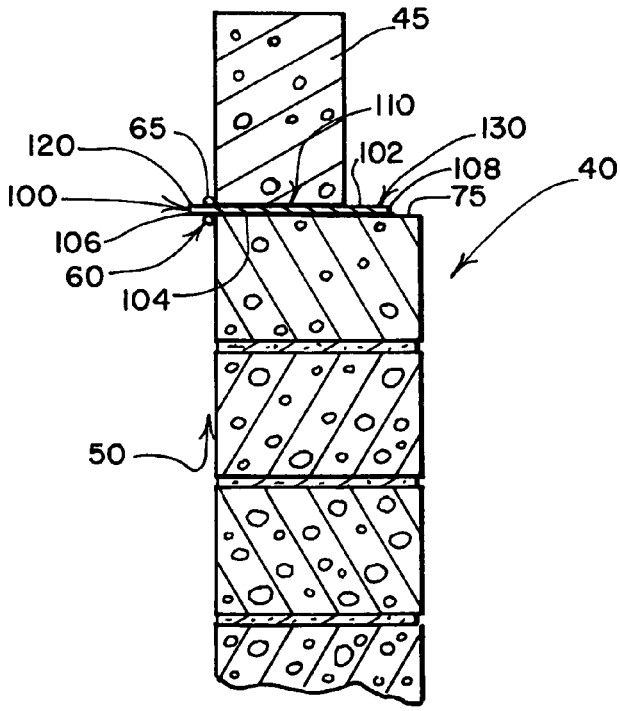
FIG. 2 is a vertical cross-sectional view on an enlarged scale, as seen from a plane indicated by a line 2-2 in FIG. 1.

In FIGS. 1, 2 and 6-8, the line holder 100 is shown in a proper position to enable the front end support portion 120 to support an intermediate reach 65 of the guide line 60 extending along and closely adjacent to the front surface plane 50 of the wall 40 at a height to be met by new bricks being added to the wall 40. When positioned as shown in FIG. 2, the line holder 100 is held in place by a spare brick 45 turned on edge and resting atop the central body portion 110 to clamp the central body portion 110 into firm engagement with the flat, upwardly facing wall surface 75—which causes the bottom surface 104 of the line holder 100 to extend at the desired height to be met by bricks being added to the wall 40.

Figure 6:
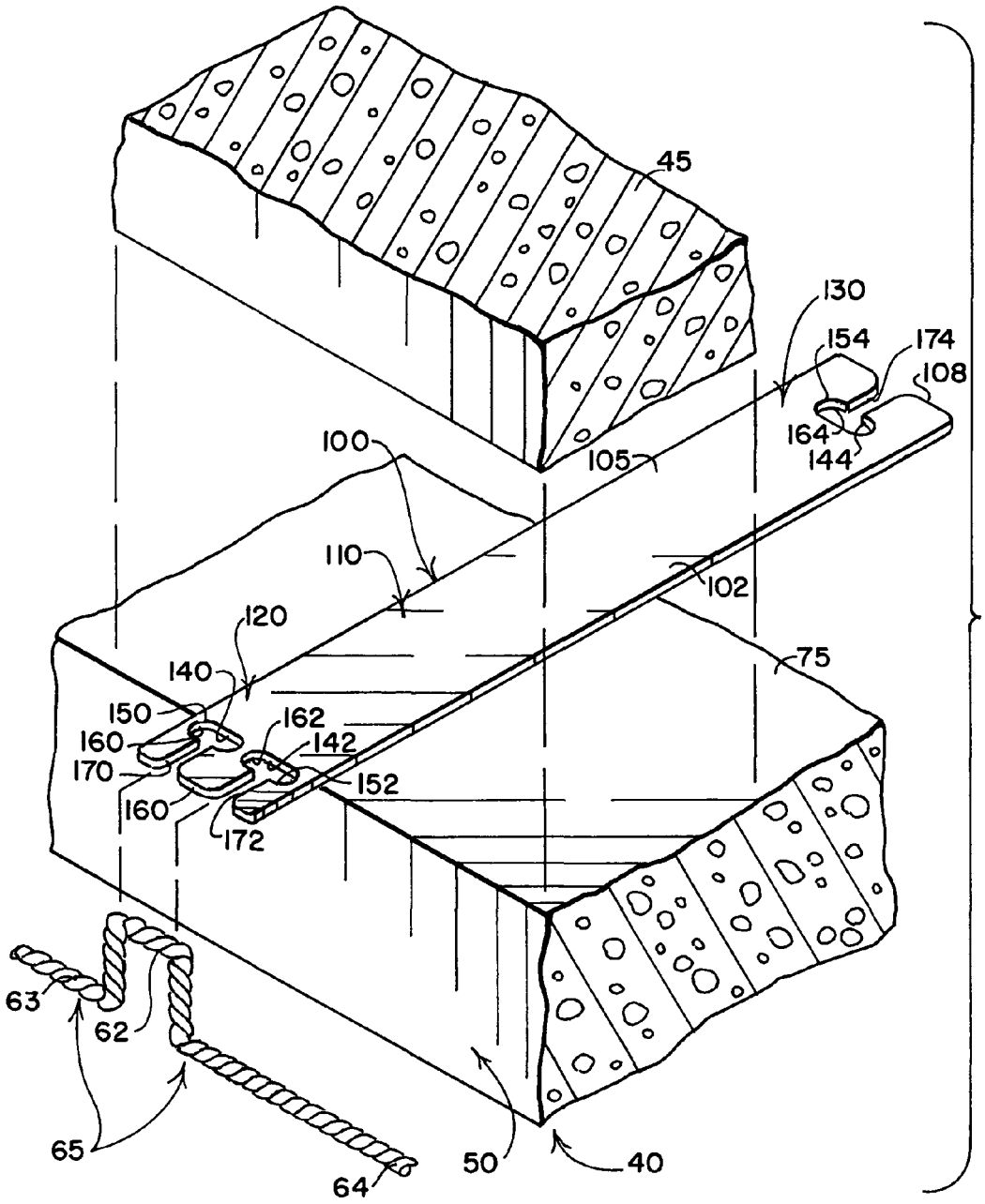
FIG. 6 is an exploded perspective view showing the guide line loop ready to be inserted along a track defined by slots formed in a forward end region of the line holder of FIG. 3, with a spare brick ready to be lowered onto a central body portion of the line holder to retain the line holder in position atop a flat upper surface of the masonry wall under construction.
Figure 7:
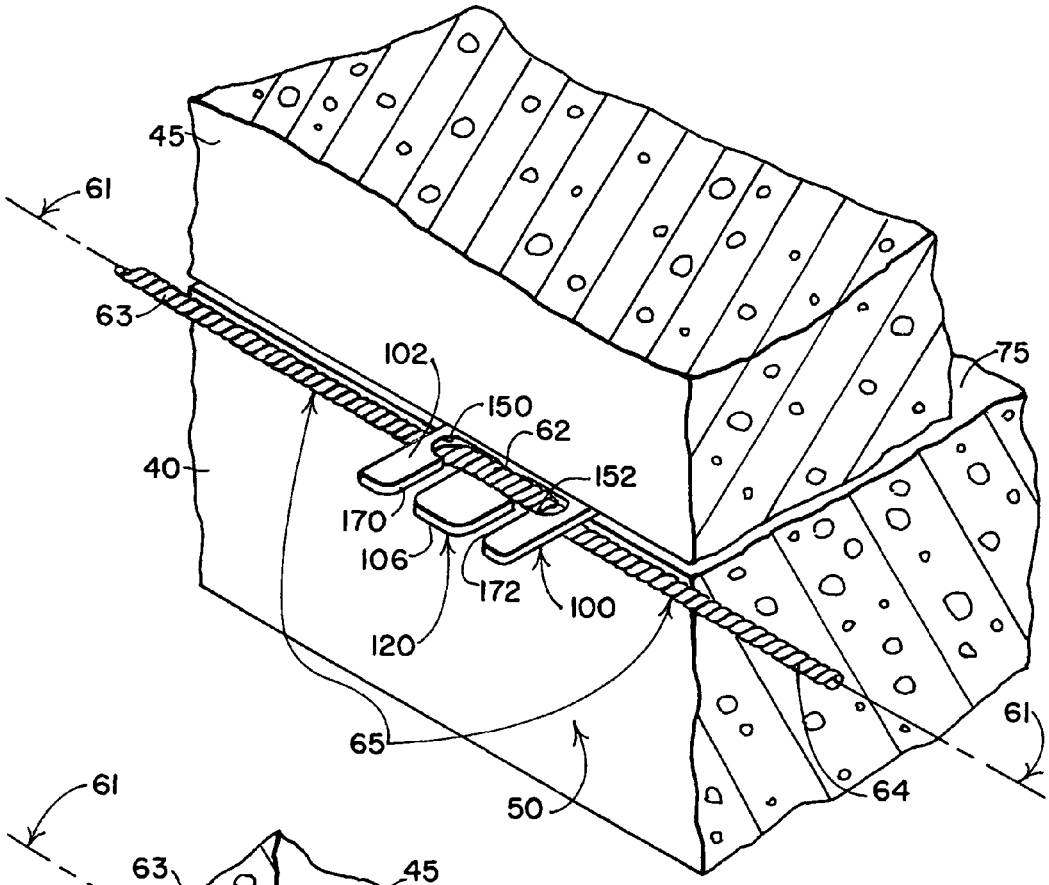
FIG. 7 is a perspective view showing the guide line loop inserted through the slots into side-by-side passages of the line holder shown in FIG. 6, with the spare overlying brick lowered onto the central body portion of the line holder to retain the line holder in place atop the flat upper surface of the masonry wall.
Figure 8:
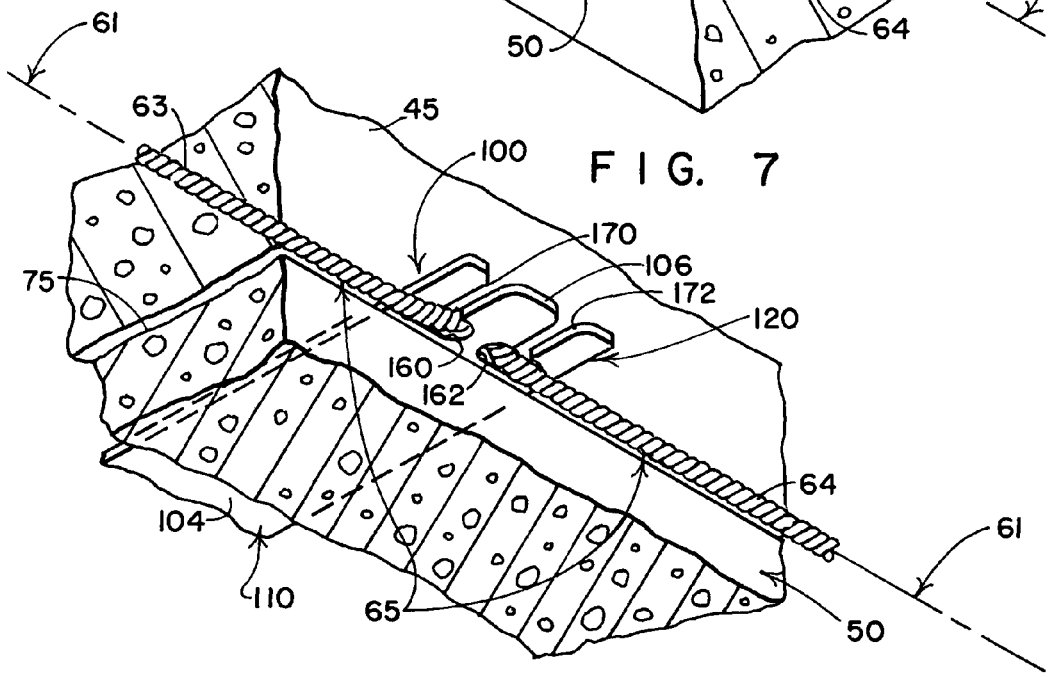
FIG. 8 is a perspective view showing bottom surface portions of the line holder together with brick portions that engage top and bottom surfaces of the line holder to sandwich and clamp the line holder in position, and showing how the guide line loop exits from two bottom openings defined where the side-by-side passages open through the bottom surface of the front portion of the line holder, wherefores the guide line extends tautly in opposite directions along a linear path adjacent a front surface plane of the wall being erected.

When the line holder 100 is positioned as shown in FIGS. 1, 2 and 6-8, the front support portion 120 projects forwardly from the front surface plane 50 of the wall 40, and the bottom surface openings 160, 162 open downwardly adjacent the front surface plane 50 (as is best seen in FIG. 8) so that, when a loop 62 of an intermediate reach 65 of the guide line 60 (such as is shown in FIG. 6) is inserted through the slots 170, 172 and into the passages 140, 142 (as shown in FIGS. 7 and 8), portions of the loop 62 are caused to exit through the bottom surface openings 160, 162 adjacent the front surface plane 50 at spaced locations so that, as the guide line 60 is drawn taut, lengthy portions or reaches 63, 64 of the guide line 60 (that extend away from the intermediate portion or reach 65 supported by the line holder 100) are caused to extend in opposite directions (along a path designated by the numeral 61 in FIGS. 7 and 8 at a desired height to be met by bricks that are added to the wall 40) away from the bottom surface openings 160, 162 at locations adjacent the front surface plane 50 of the wall 40 and at the same height as the bottom surface 104 of the line holder 100. As a result, the intermediate reach 65 of the guide line 60 is supported by the line holder 100 at a height to be met by new bricks as they are added to the wall to advance the erection of the wall 40.

Figure 9:
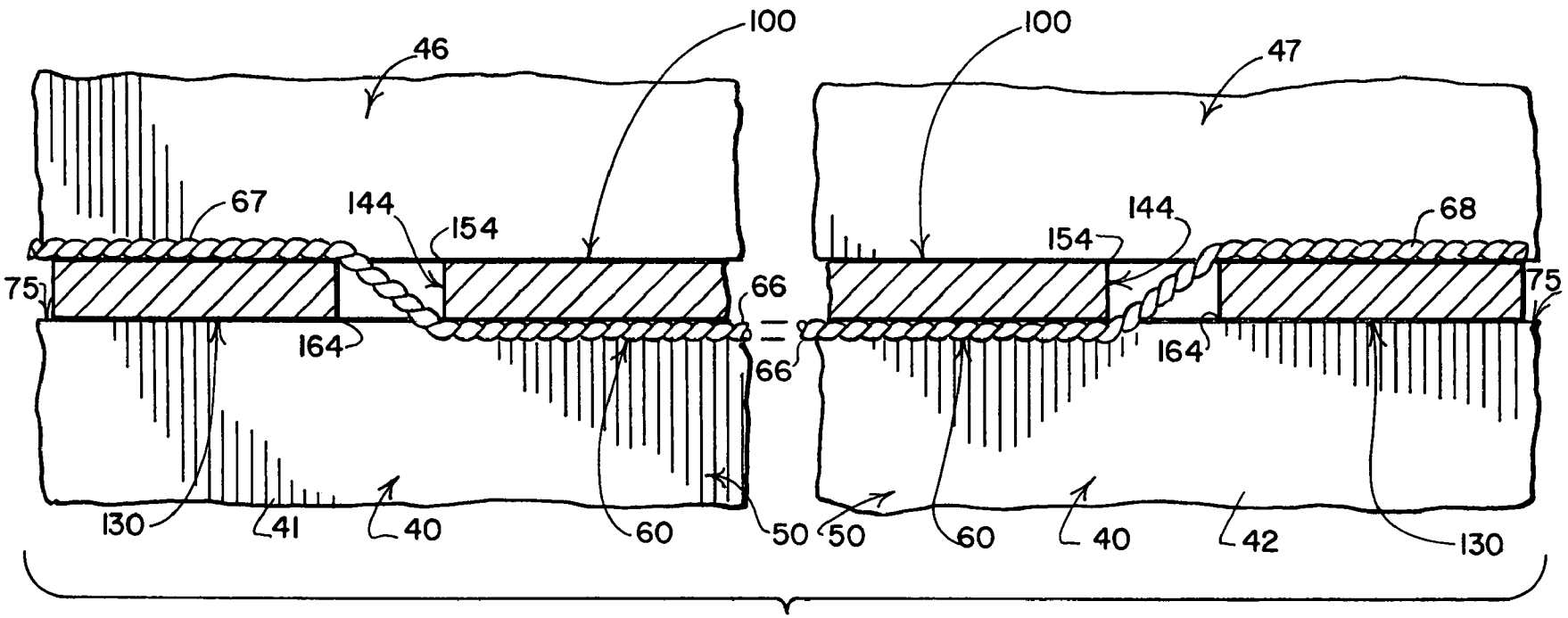
FIG. 9 is a cross-sectional view of a pair of spaced portions of a brick wall being built, showing how a pair of the rear end portions of two of the line holders of FIG. 3 may be utilized to support an intervening portion or reach of guide line at a desired level at the same height as a flat upper surface of the wall on which the two line holders are supported to indicate a height to be matched by bricks being added to the wall.

What FIG. 9 shows is how the rear end region 130 of the line holder 100 of FIG. 3 can be put to use. Depicted in FIG. 9 are spaced-apart left and right portions 41, 42 of a brick wall 40 that is being built or erected. The depicted wall portions 41, 42 have flat top surfaces 75 that (in the same manner that the flat top surface 75 shown in FIGS. 6-8 underlies and supports a central body portion 110 of the line holder 100 shown in FIGS. 6-8) underlies and supports the central body portion 110 of a left line holder 100 atop the surface 75 of the left wall portion 41, and underlies and supports the central body portion 110 of a right line holder 100 atop the surface 75 of the right wall portion 42. Spare bricks 46, 47 laid atop the left and right line holders 100, respectively, hold the left and right line holders 100 in position atop the flat surfaces 75 of the left and right wall portions 41, 42 just as a spare brick 45 laid atop the line holder 100 shown in FIGS. 7 and 8 holds the line holder 100 in place atop the flat surface 75 of the wall portion 40 shown in FIGS. 7 and 8. Rear portions 130 of the left and right line holders 100 shown in FIG. 9 are positioned to project forwardly beyond a front surface plane 50 of the portions 41, 42 of the wall 40 in the same manner that the front portion 120 of the line holder 100 shown in FIGS. 6-8 projects forwardly beyond a front surface plane 50 of the wall portion 40 shown in FIGS. 6-8).

As can be seen in FIG. 9, a guide line portion 67 overlies an upper surface portion 102 of the left line holder 100 before extending through the rear passage 144 of the left line holder 100 to provide another guide line portion 66 that extends rightwardly along a bottom surface portion 104 of the left line holder 100 toward the right line holder 100. In a mirror-image manner, a guide line portion 68 overlies an upper surface portion 102 of the right line holder 100 before extending through the rear passage 144 of the right line holder 100 to provide another guide line portion 66 that extends leftwardly along a bottom surface portion 104 of the right line holder 100 toward the left line holder 100.

When the guide line 60 shown in FIG. 9 is pulled taut, the guide line portion 66 that extends between the left and right line holders 100 is held by the line holders 100 at a correct height (even with the top surface portions 75 of the left and right wall portions 41, 42) that is to be matched as bricks are added to the wall 40 at locations (not shown) situated between the left and right line holders 100 that are shown in FIG. 9 (just as the guide line portions 63, 64 shown in FIGS. 7 and 8 are held at a correct height to be matched as bricks are added to the wall 40 at locations on opposite sides of the line holder 100 shown in FIGS. 7 and 8).

Figure 10:
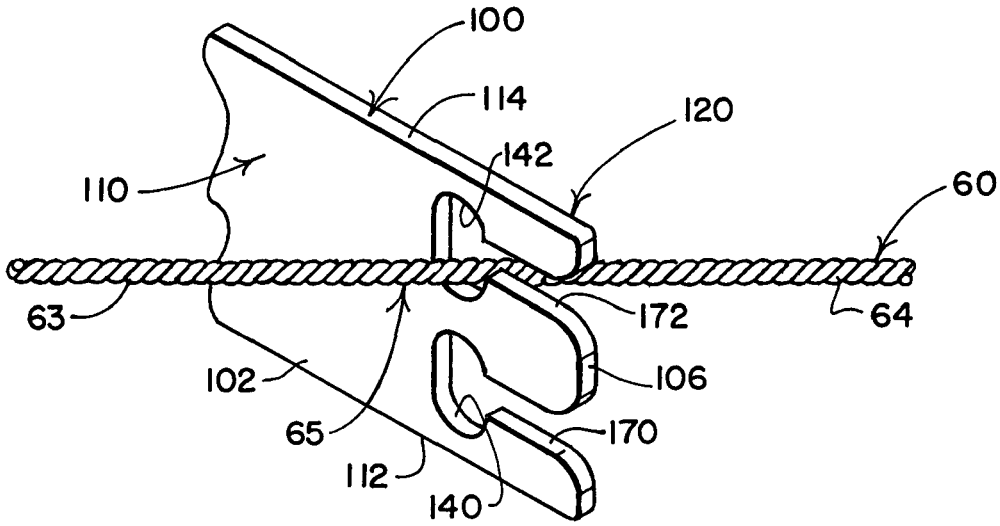
FIG. 10 is a perspective view showing a first step in a three-step procedure for properly installing a guide line reach through the side-by-side slots of a front portion of the guide line holder of FIG. 3 and into the associated side-by-side passages formed through the front portion, with the view showing the line holder turned on edge to receive the guide line reach in an upper one of the two slots.
Figure 11:
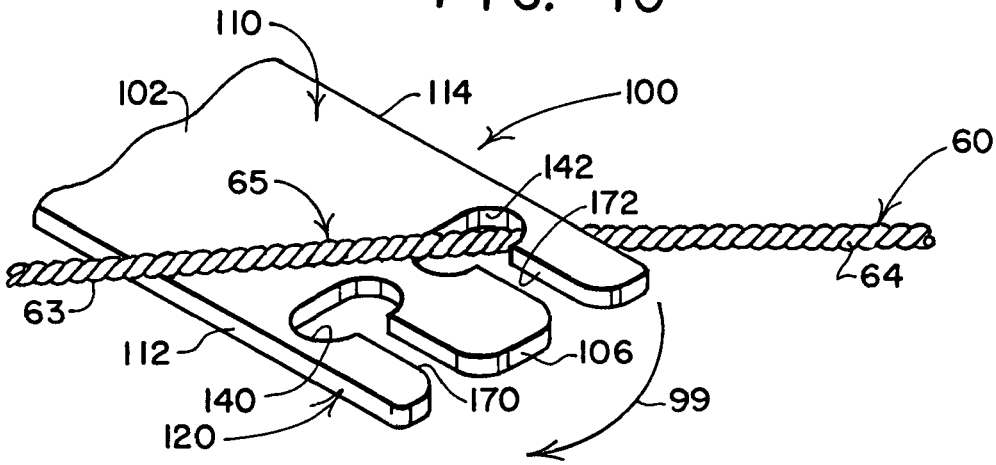
FIG. 11 is a perspective view similar to FIG. 10 showing a second step in the three-step procedure, depicting how the line holder may be turned clockwise to cause the guide line reach to extend across a top surface of a central part of the line holder.
Figure 12:
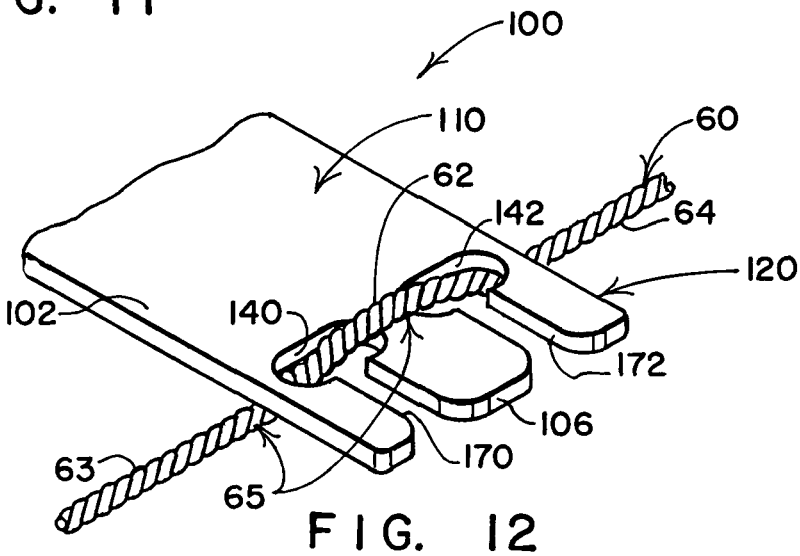
FIG. 12 is a perspective view similar to FIGS. 10 and 11 showing a third step in the three-step procedure, depicting how the guide line reach may be passed through the second of the side-by-side slots and into the second associated passage as the line holder is turned to extend substantially horizontally.

What is shown in the sequence of three views provided by FIGS. 10, 11 and 12 are three simple steps that can be followed to properly install an intermediate reach 65 of guide line 60 along tracks defined by the slots 170, 172 and into the passages 140, 142 to enable the intermediate reach 65 of the guide line 60 to be properly supported by the line holder 100. As is shown in FIG. 10, a first step is taken by turning the line holder 100 vertically (i.e., on edge), so that one of the slots 170, 172 (in this case, the slot 172) is located above the other of the slots 170, 172. The guide line portion 65 to be supported by the line holder 100 is then passed through the upper slot 172 and into the associated upper passage 142.

As is shown in FIG. 11, a second step is taken by turning the line holder 100 in either a clockwise or a counter-clockwise direction (in this case, in a clockwise direction as indicated by an arrow 99) to bring the unoccupied slot 170 and the unoccupied passage 140 near the guide line portion 65 that is to be supported by the line holder 100. And, as is shown in FIG. 12, a third step is taken by slipping a nearby part of the guide line portion 65 along the slot 170 and into the associated passage 140—which, with a minimum of fuss causes the guide line portion 65 to be properly supported by the front end region 120 of the line holder 100, in the manner shown in FIGS. 7 and 8.

Although the shape defined by the perimeter of the elongate strip 105 shown in FIG. 3 is generally rectangular, the exterior shape of the line holder 100 need not always be either elongate or rectangular, which will become more clear as this description concludes with reference to FIGS. 13-20. The line holder 100 merely needs to provide a relatively sizable centrally located body portion 110 atop which a spare brick (such as the brick 45 shown in FIGS. 1, 2 and 6-8, or the bricks 46, 47 shown in FIG. 9) can rest to retain the line holder 100 in position atop a flat wall surface 75, and needs to provide a front end portion 120 that defines two spaced passages 140, 142 that can receive the loop 62 of the intermediate reach 65 of the guide line 60.

Likewise, although the passages 140, 142 are depicted in FIG. 3 as being transversely elongate (i.e., elongate in directions paralleling the front surface plane 50 of the wall 40); and although the slots 170, 172 are shown in FIG. 3 as being of uniform width along their lengths, as extending parallel to each other and to the length of the line holder 100, and as extending through the forward end surface 106, the passages 140, 142 need not be transversely elongate in shape; and the slots 170, 172 need not be of uniform width along their lengths, nor do they need to extend in side-by-side parallel relationship, nor do the slots 170, 172 need to extend parallel to each other or to the length of the strip 105, nor do the slots 170, 172 need to exit through the forward end surface 106 of a line holder that is of generally rectangular configuration.

The passages 140, 142 (or "passage means" reasonably equivalent thereto) need merely be capable of receiving and retaining the loop 62 of the intermediate reach 65 of the guide line 60; and the slots 170, 172 (or "slot means" reasonably equivalent thereto) need merely be capable of providing a track or tracks along which portions of the guide line loop 62 can be moved into the passages 140, 142. Accordingly, the passages 140, 142 (or a reasonably equivalent "passage means") and the slots 170, 172 (or a reasonably equivalent "slot means") may take a variety of sizes and shapes, and the slots 170, 172 may differ in where they exit through an edge surface of the line holder 100.

Examples of the many ways in which the passages 140, 142 (or a reasonably equivalent "passage means"), and the slots 170, 172 (or a reasonably equivalent "slot means") can take on different sizes, shapes and edge surface exit locations are provided in FIG. 13 through FIG. 24—and yet, the resulting front end portions 120 of the depicted line holders 100 can still function in much the same way as has been described in considerable detail in conjunction with FIGS. 6-8—so that downwardly opening passage openings position portions of a loop 62 of a guide line 60 to be supported to extend along a linear path 61 closely adjacent a front wall plane 50 of a wall 40 being built or erected, and at a desired height to be met by bricks or other masonry elements being added to the wall being built or erected.

Figure 13:
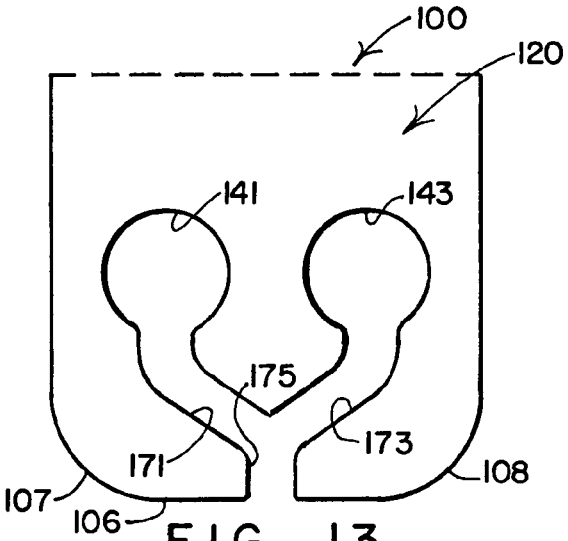
FIG. 13 is a top view of a first alternate form that can be taken by the front portion of the line holder of FIG. 3.

Referring to FIG. 13, the forward end portion 120 of a guide line holder 100 may have a pair of slot portions 171, 173 that join with a single slot portion 175 to form a Y-like track or tracks along which portions of a loop 62 of an intermediate reach 65 of a guide line 60 (as depicted, for example, in FIG. 6) can travel to pass into a pair of side-by-side passages 141, 143 that, in this embodiment, are of round cross-section instead of being of elongate cross-section like the passages 140, 142 of the line holder 100 of FIG. 3. Corner regions 107, 108 of the end surface 106 are more rounded than are corresponding corner regions of the line holder 100 shown in FIG. 3—which does nothing to alter how the line holder 100 of FIG. 13 functions in comparison to the line holder 100 of FIG. 3.

Figure 14:
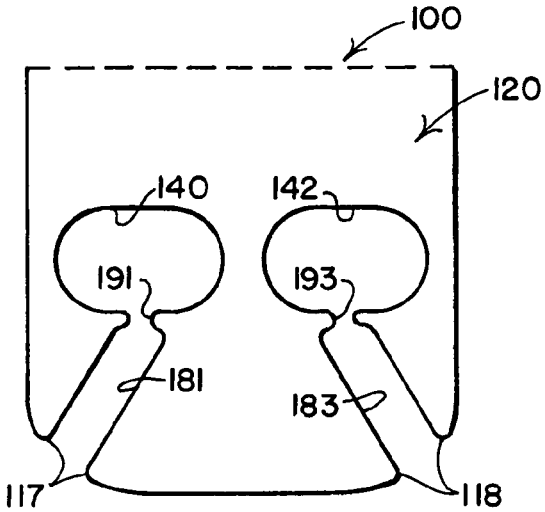
FIG. 14 is a top view of a second alternate form thereof.

Referring to FIG. 14, a pair of slots 181, 183 of a front end portion 120 of a line holder 100 are of relatively wide width until they reach choke points 191, 193 located adjacent two elongate passages 140, 142 (which may, in some applications, help to retain portions of a guide line loop 62 within the passages 140, 142). The slots 181, 183 have corner region openings 117, 118 that are situated at opposite ends of the end surface 106—and still a line holder 100 is provided that performs well, in substantially the same manner described in conjunction with the line holder depicted in FIGS. 6-8.

Figure 15:
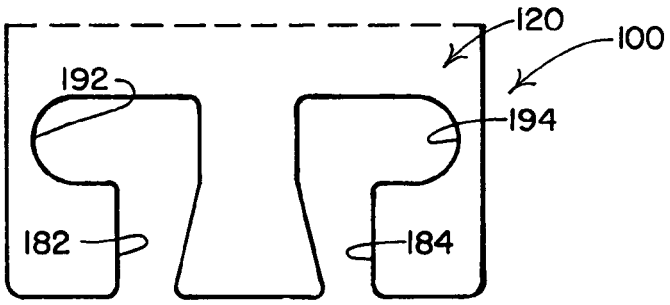
FIG. 15 is a top view of a third alternate form thereof.

Referring to FIG. 15, slots 182, 184 communicate with elongate passages 192, 194 to provide P-shaped openings through the front end portion 120 of a line holder 100.

Figure 16:
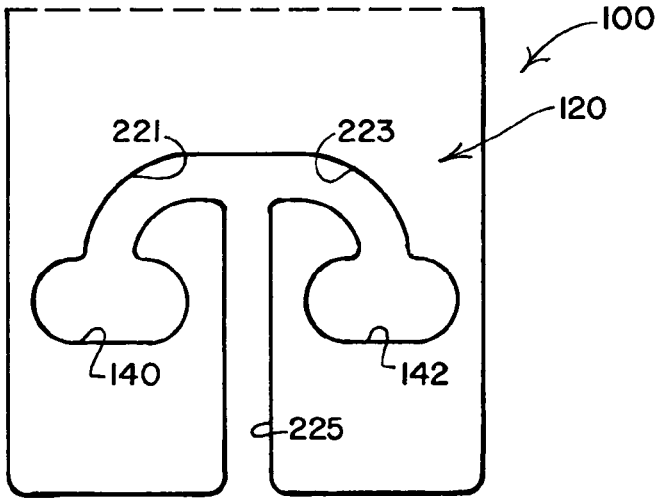
FIG. 16 is a top view of a fourth alternate form thereof.

Referring to FIG. 16, a pair of curved slot portions 221, 223 communicate with a single, centrally located slot portion 225 before opening into a pair of elongate passages 140, 142, respectively. The slot branches 221, 223, 225 provide a track or tracks along which portions of a loop 62 of guide line 60 (such as is shown in FIG. 6) can be moved to deliver a portion of a guide line loop 62 into the passages 140, 142 where the guide line loop portion 62 is retained while other portions of the guide line loop exits downwardly through bottom openings of the passages 140, 142 just as described previously in conjunction with FIGS. 7 and 8, to support an intermediate reach 65 of the guide line 60.

Figure 17:
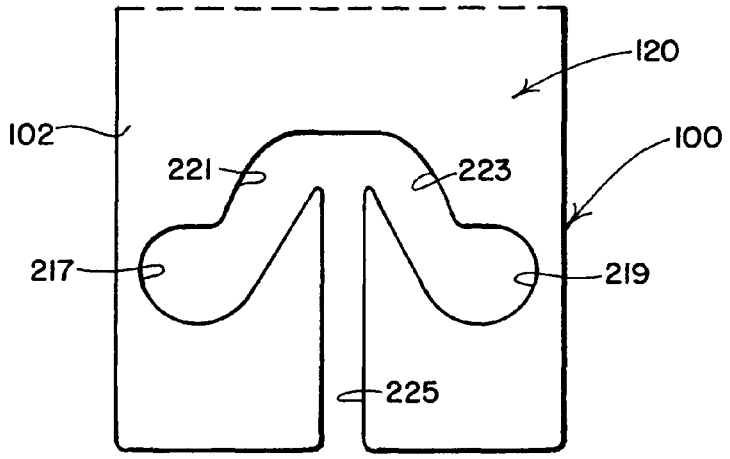
FIG. 17 is a top view of a fifth alternate form thereof.

Referring to FIG. 17, two relatively wide slot branches 221, 223 join with a relatively thin central slot branch 225 enabling portions of a guide line loop 62 to be moved a pair of rounded passages 217, 219 defined by a forward end region 120 of a line holder 100.

Figure 18:
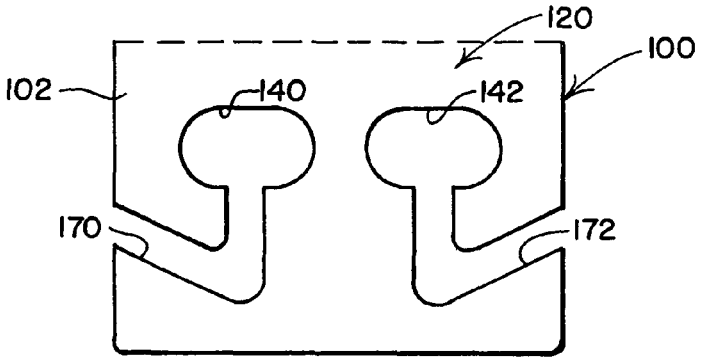
FIG. 18 is a top view of a sixth alternate form thereof.
Figure 19:
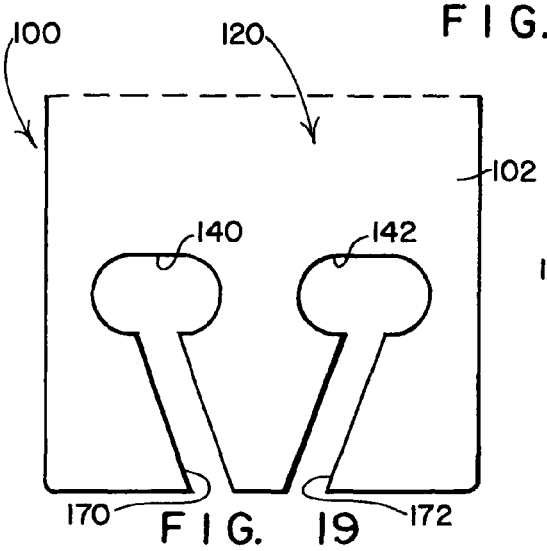
FIG. 19 is a top view of a seventh alternate form thereof.
Figure 20:
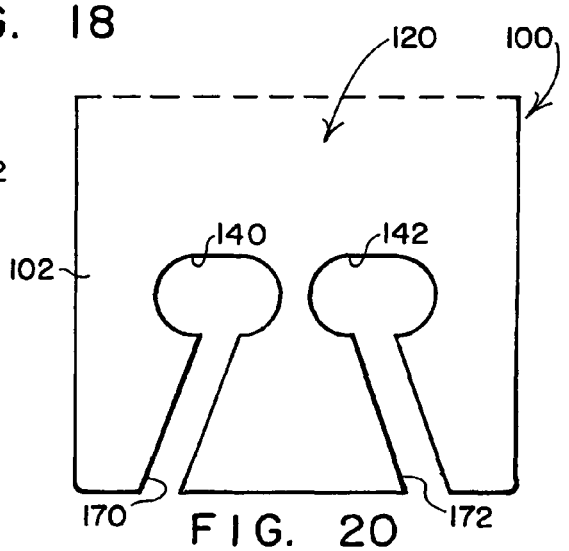
FIG. 20 is a top view of an eighth alternate form thereof.

In FIGS. 18-20, however, slots 170, 172 that open through different edge surface regions of forward end portions 120 of line holders 100 communicate with transversely elongate passages 140, 142 to enable portions of a guide line loop 62 such as is shown in FIG. 6 to travel along slot-defined tracks into the passages 140, 142 to be retained and supported by the associated guide line holders 100.

Figure 21:
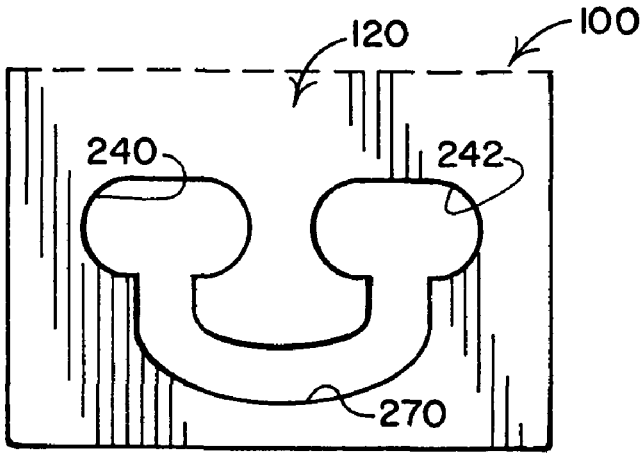
FIG. 21 is a top view of a ninth alternate form thereof.

Referring to FIG. 21, a front end portion 120 of a line holder 100 is shown that employs passages 240, 242 connected by a C-shaped slot 270 that does not open through any edge surface of the line holder 100. Configurations such are exemplified by the line holder front end portion 120 shown in FIG. 21 provide still another type of approach that can be taken by the present invention to use what can be referred to as "slot means" that communicates with "passage means" to permit a loop 62 of a guide line 60 (such as is shown in FIG. 6) to be moved along one or more tracks defined by the "slot means" and into the "passage means" to be retained so the line holder 100 performs in substantially the same way as the line holder 100 depicted in FIG. 8.

Figure 22:
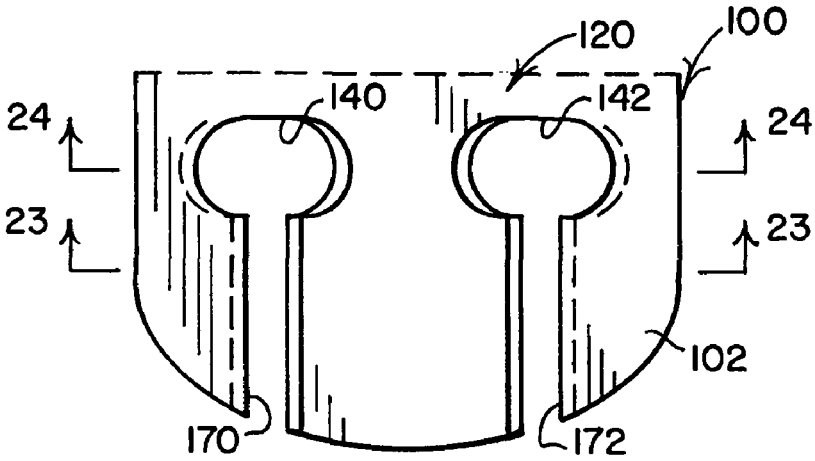
FIG. 22 is a top view of a tenth alternate form thereof.
Figure 23:
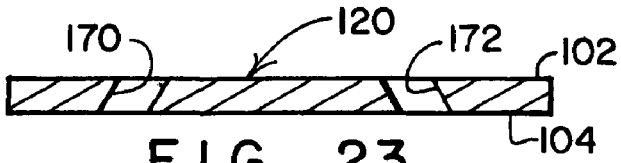
FIGS. 23 and 24 are cross-sectional views as seen from planes indicated by lines 23-23 and 24-24, respectively, in FIG. 22.
Figure 24:
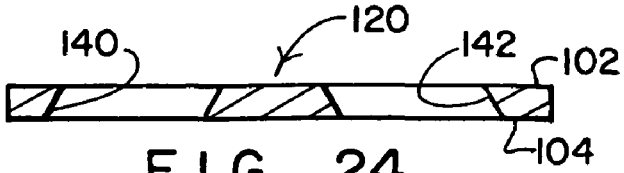

Finally, referring to FIGS. 22-24, a front end portion 120 of a line holder 100 is shown that employs passages 140, 142 and communicating slots 170, 172 that do not extend straight through the line holder 100 (i.e., not extending perpendicular to the top and bottom surfaces 102, 104, as do the many other slots and passages of the various line holder forms that are shown in other drawing views). Instead, the slots 170, 172 and the passages 140, 142 shown in FIGS. 22-24 are inclined relative to the top and bottom surfaces 102, 104, respectively—as is made clear in the cross-sectional views provided by FIGS. 23 and 24. Slot or passage inclination alterations of this type may also be applied to the various other slot and passage configurations employed by the various other types of line holder configurations disclosed herein without departing from the spirit and scope of the present invention.

As those who are skilled in the art will readily understand, line holders 100 that embody features of the present invention may be formed from a wide variety of materials including but not limited to metals such as steel, tin, brass and aluminum; from plastics materials including but not limited to nylon, thermoplastic materials such as PVC, TPU, PP, TPE and ABS, and the like; and even from organic materials such as strips of wood, bamboo and the like, and other stiff, thin, flat, durable materials, some of which may not even be known at present.

Although the invention has been described in its preferred form with a certain degree of particularity, it is understood that the present disclosure of the preferred form shown in FIG. 3 has been made only by way of example, and that numerous changes in the details of construction and the combination and arrangement of parts may be resorted to without departing from the spirit and scope of the invention. It is intended to protect whatever features of patentable novelty exist in the invention disclosed.

What is claimed is:

1. A line holder comprising a one-piece, thin, elongate, generally rectangular member having one end including one end surface defined by the generally rectangular shape of the member, having an opposite end including an opposite end surface defined by the generally rectangular shape of the member and opposite the one end surface, having two side-by-side passages extending through the member at locations spaced short distances from the one end surface of the member, having a single passage extending through the member at a location spaced a short distance from the opposite end surface of the member, having a pair of side-by-side parallel slots each communicating with a different one of the side-by-side passages and opening through the one end surface, and having a single slot communicating with the single passage and opening through the opposite end surface.

2. The line holder of claim 1 wherein the passages have cross-sections that are elongate in directions extending transverse to the length of the elongate strip and transverse to the slots.

3. The line holder of claim 2 wherein the slots are of substantially uniform width along their lengths, and wherein each slot opens into a corresponding one of the elongate passages substantially midway along their length.

4. A line holder for receiving and supporting a loop of a masonry worker's guide line to position portions of the guide line located on opposite sides of the loop to extend along a linear path at a desired height adjacent a front plane of a wall being erected, comprising a thin, flat, relatively stiff member having a centrally located body portion positionable flatly atop a horizontal surface of the wall at the desired height while being secured in place by placement of a masonry element acting as a weight atop the centrally located body portion, and an integral, forwardly projecting guide line support portion adapted to extend forwardly from the centrally located body and the surface plane 1) to define passage means configured to open downwardly through a bottom surface of the support portion at two side-by-side locations along said path adjacent the front surface plane, and 2) to define slot means communicating with the passages means and configured to permit insertion of the loop into the downwardly opening passage means so the loop is supported by the line holder when the guide line is drawn taut in opposite directions extending along said path, wherein at least a portion of the slot means extends transversely relative to the linear path and wherein at least a portion of the passage means is elongate in a direction along the linear path.

5. The line holder of claim 4 wherein the passage means includes two passages extending through the thin member and defining two downwardly facing openings in a bottom surface of the support portion, and two upwardly facing openings in a top surface of the support portion.

6. The line holder of claim 5 wherein the passages have cross-sections that are elongate in said opposite directions, and the openings defined by the passages also are elongate in said opposite directions.

7. The line holder of claim 5 wherein the slot means includes two slots each communicating with a different one of the two passages, and wherein the two slots extend side-by-side in substantially parallel relationship and open through a forwardly facing front end surface defined by the forwardly projecting support portion of the line holder.

8. A line holder for accurately positioning an intermediate reach of a mason's guide line used in laying a horizontal row of masonry elements while erecting a wall, comprising a one-piece, stiff, elongate, flat strip having an end region defining two side-by-side passages extending through the strip at locations spaced a relatively short distance from an end surface of the end region, and defining two side-by-side elongate slots each having a slot portion located adjacent to and communicating with a different one of the passages, with the slots extending substantially parallel to each other and in lengthwise directions paralleling the elongate shape of the strip to open through the end surface, and with the passages having widths measured transverse to the lengthwise directions that are greater than are widths of slot portions located adjacent to and communicating with the passages.

9. The line holder of claim 8 additionally having a single passage extending through the strip at a location spaced substantially the same relatively short distance from an opposite end surface of the strip, and having a slot that communicates with the single passage and extends in a lengthwise direction relative to the elongate shape of the strip to open through the opposite end surface.

10. The line holder of claim 8 wherein the elongate strip has a substantially rectangular shape.

11. A line holder comprising a one-piece stiff, flat, elongate strip having one end and an opposite end defined by the elongate shape of the strip, having two side-by-side passages extending through the strip at locations spaced substantially equidistantly from an end surface at the one end of the strip, wherein the passages each communicate with a different one of two slots extending through a thickness of the strip and in a lengthwise direction relative to the elongate shape of the strip to open through the end surface, wherein the passages are transversely wider relative to the lengthwise direction than are portions of the slots located adjacent to and communicating with the passages.

12. The line holder of claim 11 additionally including a single passage extending through the strip at a location spaced from an opposite end surface at the opposite end of the strip and communicating with a third slot extending through the thickness of the strip and in the lengthwise direction to open through the opposite end surface of the strip.

13. A line holder for supporting and positioning an intermediate reach of a mason's guide line when drawn taut to extend away from the line holder in opposite directions along a linear path at a desired height adjacent a front surface plane of a wall being built, comprising a thin, stiff, elongate member having a centrally located body portion positionable atop a horizontal surface of the wall at the desired height, and having a guide line support portion formed integrally with and projecting forwardly from the body portion 1) to define passage means opening downwardly through a bottom surface of the support portion at two locations along the linear path within the front surface plane, and 2) to define slot means communicating with the passage means to provide a track along which a loop of the reach can be moved into the passage means to depend through the bottom surface at said locations; wherein:

the passage means defines two bottom surface openings at said locations, both of which openings are elongate in directions extending along said path;

the passage means includes two elongate passages each communicating with a different one of the two elongate bottom surface openings;

the slot means includes a single C-shaped slot communicating at one end with one of the elongate passages, and at the other end with the other of the elongate passages; and the one end opens into the one elongate passage midway along the length of the one elongate passage, and the opposite end opens into the other elongate passage midway along the length of the other elongate passage.

14. A one-piece line holder formed as a stamping from a thin, stiff, flat, elongate strip of metal, the line holder having a generally elongate rectangular shape defining one and opposite end regions that define one and opposite end surfaces, respectively, that define portions of the perimeter of the generally elongate rectangular shape and extend transversely to the length of the generally elongate rectangular shape, having only two side-by-side passages extending through a thickness of the one end region, having only a single passage extending through a thickness of the opposite end region, with only two slots extending separately through the thickness of the one end region from each of the two side-by-side openings and through the one end surface, and with only one slot extending through the thickness of the opposite end region from the single passage and through the opposite end surface such that the perimeter is interrupted only by the two slots extending through the one end surface and the one slot extending through the opposite end surface.

15. The line holder of claim 14 wherein the passages have cross-sections that are elongate in directions extending transverse to the length of the generally elongate rectangular strip and transverse to corresponding ones of the slots.

16. The line holder of claim 15 wherein the slots are of substantially uniform width along their lengths, and wherein each slot opens into a corresponding one of the elongate passages substantially midway along their length.

17. The line holder of claim 14 wherein the slots extend substantially parallel to the length of the generally elongate rectangular shape.

18. The line holder of claim 14 wherein the generally elongate rectangular shape defines one side surface and an opposite side surface that parallel the length of the generally elongate rectangular shape, and wherein the generally elongate rectangular shape includes four slightly round corners joining adjacent ones of the one and opposite end surfaces to the one and opposite side surfaces.

19. A line holder for supporting and positioning an intermediate reach of a mason's guide line when drawn taut to extend away from the line holder in opposite directions along a linear path at a desired height adjacent a front surface plane of a wall being built, comprising a thin, stiff, elongate member having a centrally located body portion positionable atop a horizontal surface of the wall at the desired height, and having a guide line support portion formed integrally with and projecting forwardly from the body portion 1) to define passage means opening downwardly through a bottom surface of the support portion at two locations along the linear path within the front surface plane, and 2) to define slot means communicating with the passage means to provide a track along which a loop of the reach can be moved into the passage means to depend through the bottom surface at said locations; wherein:

the passage means defines two bottom surface openings at said locations, both of which openings are elongate in directions extending along said path;

the passage means includes two elongate passages each communicating with a different one of the two elongate bottom surface openings;

the slot means includes two parallel slots, each separately communicating at one end with one of the elongate passages, and each separately opening at the other end through a forwardly facing end surface of the guide line support portion; and the one end of each of the two parallel slots opens into a corresponding one of the elongate passages midway along the length of the corresponding one of the elongate passages.

20. The line holder of claim 19 further comprising an opposite guide line support portion formed integrally with and projecting rearwardly from the body portion in a direction opposite the forward direction in which the guide line support projects, the opposite guide support portion having a single passage opening downwardly through a bottom surface of the opposite support portion at a single location, and having a single slot communicating at one end with the single passage and opening through a rearward facing end surface of the opposite guide support portion at the other end, wherein:

the thin and elongate shape of the line holder defines two side surfaces extending substantially parallel to the elongate length of the thin and elongate shape of the line holder; and adjacent ones of the two side surfaces, the forward facing end surface and the rearward facing end surface define a perimeter of the thin and elongate shape through which only the two parallel slots and the single slot open.

* * * * *